US005673639A

United States Patent [19]

Miyachi et al.

[11] Patent Number: 5,673,639

[45] Date of Patent: Oct. 7, 1997

[54] METHOD OF FEEDING A PIECE OF TAPE TO A BELT LOOP SEWING MACHINE AND TAPE FEEDER FOR EFFECTING SAME

[75] Inventors: Kouji Miyachi, Kyoto; Ryoichi Kazuno, Otsu, both of Japan

[73] Assignee: Hams Corporation, Kyoto, Japan

[21] Appl. No.: 547,202

[22] Filed: Oct. 24, 1995

[30] Foreign Application Priority Data

Oct. 25, 1994 [JP] Japan ..... 6-299131

[51] Int. Cl.[6] ..... D05B 3/12

[52] U.S. Cl. ..... 112/470.34; 112/475.06; 112/475.07

[58] Field of Search ..... 112/470.34, 470.33, 112/104, 113, 120, 147, 152, 475.06, 475.07, 475.04, 475.09

[56] References Cited

U.S. PATENT DOCUMENTS

| | | | |
|---|---|---|---|
| 2,827,867 | 3/1958 | Happe . | |
| 3,792,672 | 2/1974 | Friedman et al. . | |
| 3,799,088 | 3/1974 | Marforio . | |
| 3,800,717 | 4/1974 | Olday . | |
| 4,114,544 | 9/1978 | Miyachi et al. | 112/104 |
| 4,127,075 | 11/1978 | Adamski, Jr. et al. . | |
| 4,389,957 | 6/1983 | Block et al. | 112/262.3 |
| 4,502,399 | 3/1985 | Seaman | 112/104 X |
| 4,561,366 | 12/1985 | Schmidt et al. . | |
| 4,632,047 | 12/1986 | Seaman . | |
| 4,709,645 | 12/1987 | Jones et al. . | |
| 4,803,935 | 2/1989 | Off | 112/121.27 |
| 5,417,174 | 5/1995 | Allison et al. | 112/470.34 X |

FOREIGN PATENT DOCUMENTS

| | | |
|---|---|---|
| 1231198 | 12/1966 | Germany . |
| 58-29119 | 6/1983 | Japan . |
| 560273 | 3/1975 | Switzerland . |

OTHER PUBLICATIONS

European Search Report and Annex.

*Primary Examiner*—Peter Nerbun

*Attorney, Agent, or Firm*—Greenblum & Bernstein, P.L.C.

[57] ABSTRACT

A sewing machine has a tape feeder for feeding a piece of tape thereto. The tape feeder includes a triple cylinder unit having first, second and third cylinders connected in series with one another. One end of the triple cylinder unit is pivotally connected to a feeder carrier. The tape feeder further includes a movable bracket connected to the other end of the triple cylinder unit, two tape folding shafts rotatably carded by the movable bracket for folding opposite ends of the piece of tape, and a controller for controlling the triple cylinder unit and the tape folding shafts. Actuation of the first cylinder moves the tape folding shafts towards a first position, at which the piece of tape is placed, so that distal ends of the tape folding shafts are located at the first position. Then, the two tape folding shafts are rotated in opposite directions to thereby fold the opposite ends of the piece of tape. A subsequent actuation of the second cylinder moves the tape folding shafts towards a second position adjacent to a sewing plate mounted on the sewing machine so that the piece of tape held by the tape folding shafts is located at the second position. A subsequent actuation of the third cylinder moves the tape folding shafts towards a third position so that the piece of tape held by the tape folding shafts is located immediately below two holding members mounted on the sewing machine.

6 Claims, 10 Drawing Sheets

METHOD OF FEEDING A PIECE OF TAPE TO A BELT LOOP SEWING MACHINE AND TAPE FEEDER FOR EFFECTING SAME

BACKGROUND OF THE INVENTION

1. Field of the Invention

The present invention relates to a method of feeding to a belt loop sewing machine a piece of tape which is to be sewn as a belt loop on a garment such as, for example, pants, jeans or the like by the belt loop sewing machine. The present invention also relates to a tape feeder for effecting this method.

2. Description of Related Art

FIGS. 14 and 15 depict a belt loop sewing machine M for sewing a required number of belt loops on a garment placed on a sewing plate 27, and a conventional tape feeder F juxtaposed therewith for successively feeding pieces of tape of a predetermined length to the sewing machine M. The tape feeder F comprises two bifurcated tape folding shafts 11*a* and 11*b* extending generally parallel to each other, and a pair of tape receiving plates 13*a* and 13*b* disposed obliquely upwardly of the sewing plate 27. Each of the tape folding shafts 11*a* and 11*b* has a center pin and a side pin both extending from a distal end thereof in parallel to each other.

When a piece T1 of tape is sewn as a belt loop on the garment placed on the sewing plate 27, the piece T1 of tape is first placed on the tape receiving plates 13*a* and 13*b*, and opposite ends thereof are subsequently folded and held by the two tape folding shafts 11*a* and 11*b*. The piece T1 of tape held by the tape folding shafts 11*a* and 11*b* is caused to wait at this position until a start switch 24 is switched on (stand-by condition). As shown in FIG. 15, when an operator or attendant worker switches on the start switch 24 to start a sewing operation, the tape folding shafts 11*a* and 11*b* are moved towards the sewing machine M at a single stroke to directly feed the piece T1 of tape held by the tape folding shafts 11*a* and 11*b* (indicated by a solid line) to a position (indicated by a double-dotted chain line) immediately below two holding members 23*a* and 23*b*.

The belt loop sewing machine employing the above-described method has been proposed by the inventors of this application and has been granted both in the United States of America and in Japan (U.S. Pat. No. 4,114,544 and JP 1200304). This belt loop sewing machine is now commercially available and is indispensable to reduce time and labor required for belt loop sewing operations in which a required number of belt loops are sewn on trousers. For this reason, this belt loop sewing machine is now widely used in the industry associated with pants, jeans or the like, and greatly contributes to an increase in productivity.

With the belt loop sewing machine referred to above, the operator sitting in front of the sewing machine M and grasping a waist part G of trousers with his or her hands R and L inserts the waist part G of the trousers to a space between the holding members 23*a* and 23*b* and the sewing plate 27 to place it on the sewing plate 27 prior to a sewing operation, as shown in FIGS. 14 and 15. Then, the sewing operation is started by depressing the start switch 24 with the operator's right hand R.

At this moment, however, if the operator raises his right hand R above the sewing plate 27, there is a danger of his right hand R being injured by the tape folding shafts 11*a* and 11*b* advancing above the sewing plate 27.

Furthermore, because the tape folding shafts 11*a* and 11*b* are moved from the stand-by position towards the sewing machine M at a single stroke as if they are directed to his right hand R, the operator is forced to have a risk of being injured in contact with the tape folding shafts 11*a* and 11*b* during the sewing operation.

In particular, where the piece T1 of tape is sewn on a front right end portion of the waist part G of the trousers, it is very likely that the operator's right hand R protrudes above the sewing plate 27 and, hence, it is necessary to pay scrupulous attention so as not to be injured.

Also, as shown in FIG. 14, the tape feeder F is provided with two tape aligning and holding mechanisms 15*a* and 15*b* disposed obliquely above the sewing machine M and spaced about 110 mm away therefrom. Each of the tape aligning and holding mechanisms 15*a* and 15*b* includes a guide rod 16*a* or 16*b* for laterally moving a length of tape T placed on the tape receiving plates 13*a* and 13*b* until the side edge thereof is brought into contact with an outwardly facing surface of a tape receiving piece 14*a* or 14*b* (only 14*b* is shown). Each of the tape aligning and holding mechanisms 15*a* and 15*b* further includes a compression coil spring 17*a* or 17*b* for pressing the tape T against the tape receiving plate 13*a* or 13*b*. Because the tape aligning and holding mechanisms 15*a* and 15*b* are relatively complicated, they hinder the operator in recognizing the state of the piece T1 of tape placed on the tape receiving plates 13*a* and 13*b* or held by the tape folding shafts 11*a* and 11*b*. An insufficient recognition of the piece T1 of tape often results in an undesired feed of a defective piece of tape to the sewing machine M.

SUMMARY OF THE INVENTION

The present invention has been developed to overcome the above-described disadvantages.

It is accordingly an objective of the present invention to provide a tape feeding method and a tape feeder free from a danger of an operator being injured by tape folding shafts which are to be moved towards a sewing machine upon folding of opposite ends of the piece of tape.

Another objective of the present invention is to provide the tape feeding method and tape feeder of the above-described type which enable the operator to easily recognize the state of the piece of tape whose opposite ends have been folded by the tape folding shafts.

In accomplishing the above and other objectives, the method of the present invention comprises the steps of:

(a) folding opposite ends of a piece of tape at a position spaced away from a sewing plate mounted on a sewing machine;

(b) moving the piece of tape to a stand-by position adjacent to the sewing plate; and (c) further moving the piece of tape to a position below a holding means mounted on the sewing machine so that the piece of tape is sewn as a loop belt on a garment.

Advantageously, the stand-by position is above a side edge of the sewing plate.

It is preferred that the step (b) is completed before a previous piece of tape is sewn on the garment.

Conveniently, the step (a) is carried out by rotating two bifurcated tape folding shafts in opposite directions.

The tape feeder of the present invention comprises a feeder carrier and a triple cylinder unit having opposite first and second ends and also having first, second and third cylinders connected in series with one another. The first end of the triple cylinder unit is pivotally connected to the feeder carrier. The tape feeder further comprises a movable bracket connected to the second end of the triple cylinder unit, two tape folding shafts rotatably carried by the movable bracket for folding opposite ends of a piece of tape, and a control means for controlling the triple cylinder unit and the tape folding shafts.

With the above-described construction, actuation of the first cylinder moves the tape folding shafts towards a first position, at which the piece of tape is placed, so that distal ends of the tape folding shafts are located at the first position. The two tape folding shafts are then rotated in opposite directions to thereby fold and hold the opposite ends of the piece of tape. A subsequent actuation of the second cylinder moves the tape folding shafts towards a second position adjacent to the sewing plate so that the piece of tape held by the tape folding shafts is located at the second position. Then, actuation of the third cylinder moves the tape folding shafts towards a third position so that the piece of tape held by the tape folding shafts is located immediately below the holding means.

BRIEF DESCRIPTION OF THE DRAWINGS

The above and other objectives and features of the present invention will become more apparent from the following description of a preferred embodiment thereof with reference to the accompanying drawings, throughout which like pans are designated by like reference numerals, and wherein.

DETAILED DESCRIPTION OF THE PREFERRED EMBODIMENT

Figure 1:
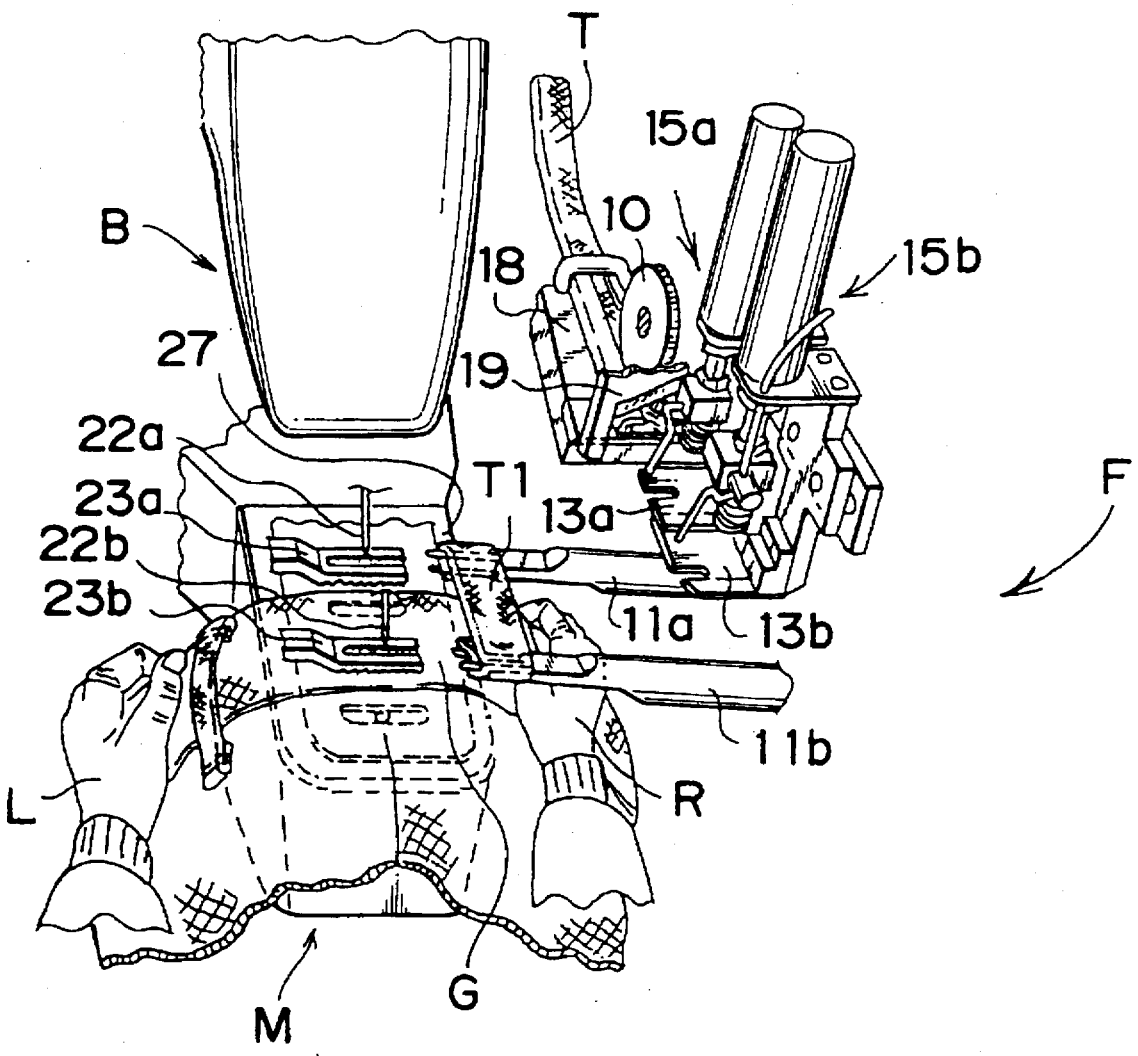
FIG. 1 is a perspective view of a sewing machine having a tape feeder according to the present invention.

Referring now to the drawings, there is shown in FIG. 1 a sewing machine M dedicated for use in sewing belt loops on a garment such as, for example, pants, jeans or the like.

The sewing machine M comprises a machine body B and a tape folding and feeding apparatus F juxtaposed therewith for cutting a length of tape T into pieces T1 of a predetermined length and for feeding each piece T1 of tape towards the machine body B. The tape folding and feeding apparatus F is hereinafter referred to simply as a tape feeder.

The machine body B comprises a sewing plate 27 on which the garment is to be placed, two holding members 23*a* and 23*b* for holding opposite ends of a piece T1 of tape on the sewing plate 27, and two needles 22*a* and 22*b* for sewing a plurality of belt loops on the garment. The tape feeder F comprises a tape feed platform 18 on which a length of tape T is placed, a tape feed roller 10 disposed above the tape feed platform 18 for feeding the tape T, a movable blade 19 disposed downstream of the tape feed platform 18 with respect to a direction of travel of the tape T for cutting the tape T into pieces T1 of a predetermined length, and a pair of tape receiving plates 13*a* and 13*b* disposed downstream of the movable blade 19 for successively receiving thereon the pieces T1 of tape cut by the movable blade 19. The tape feeder F also comprises two bifurcated tape folding shafts 11*a* and 11*b* extending parallel to each other in a direction generally perpendicular to the direction of travel of the tape T.

Figure 5:
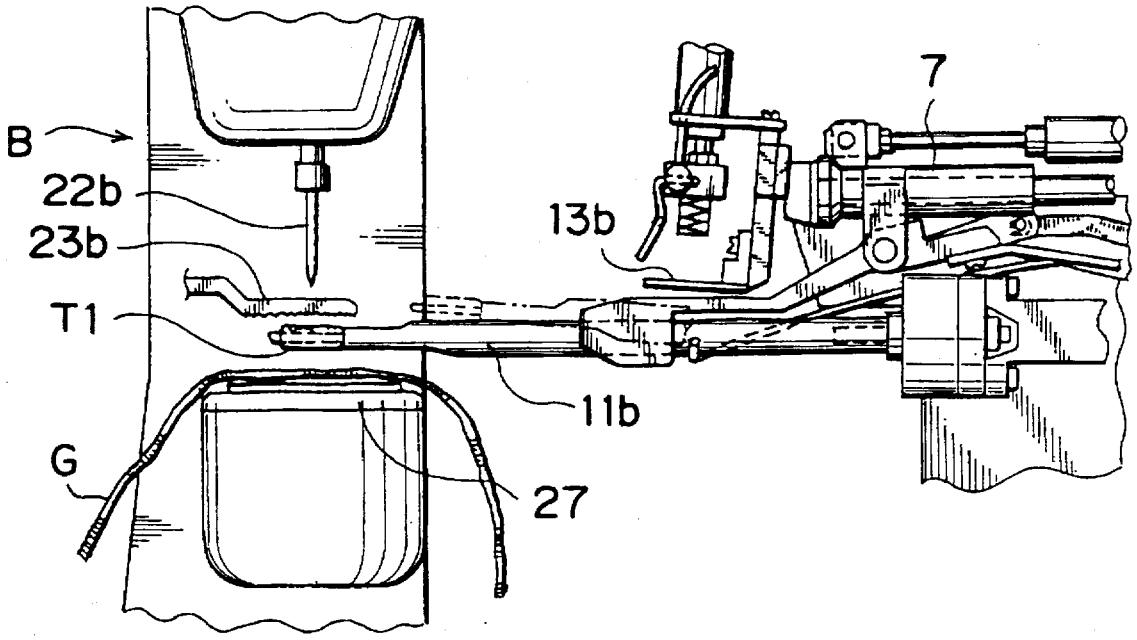
FIG. 5 is a view similar to FIG. 2, but indicating the state in which a piece of tape folded and held by the tape folding shafts has been fed immediately below holding members mounted on the sewing machine.

As shown in FIG. 5, when the opposite ends of the piece T1 of tape are first folded by associated tape folding shafts 11*a* and 11*b*, and the piece T1 of tape is subsequently fed onto a waist part G of trousers placed on the sewing plate 27, the holding members 23*a* and 23*b* are moved downwardly to press the folded ends of the piece T1 of tape against the sewing plate 27. Then, the two needles 22*a* and 22*b* are moved vertically reciprocally to simultaneously sew associated folded ends of the piece T1 of tape on the waist part G of the trousers.

Figure 3:
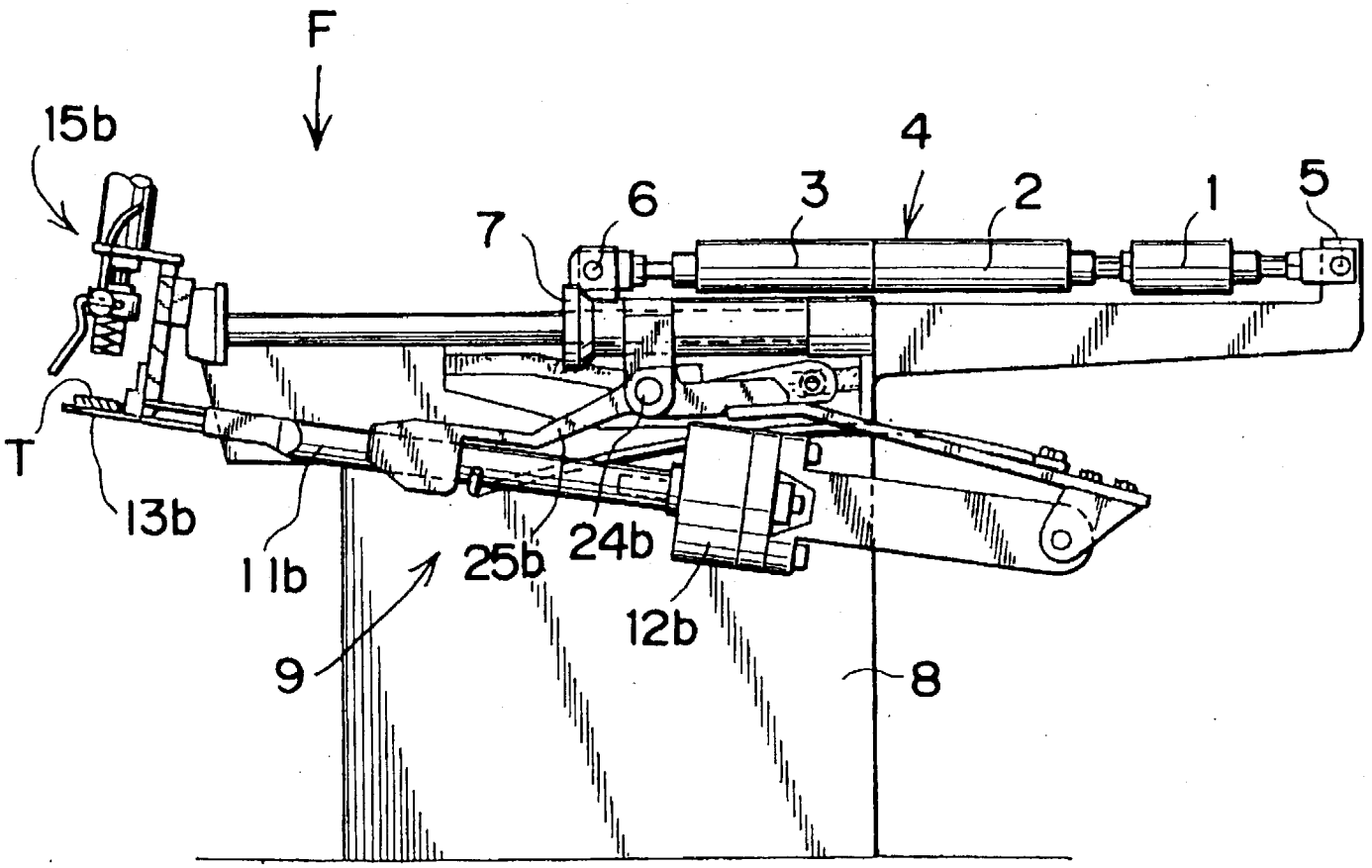
FIG. 3 is a front elevational view of the tape feeder shown in FIG. 2.
Figure 7:
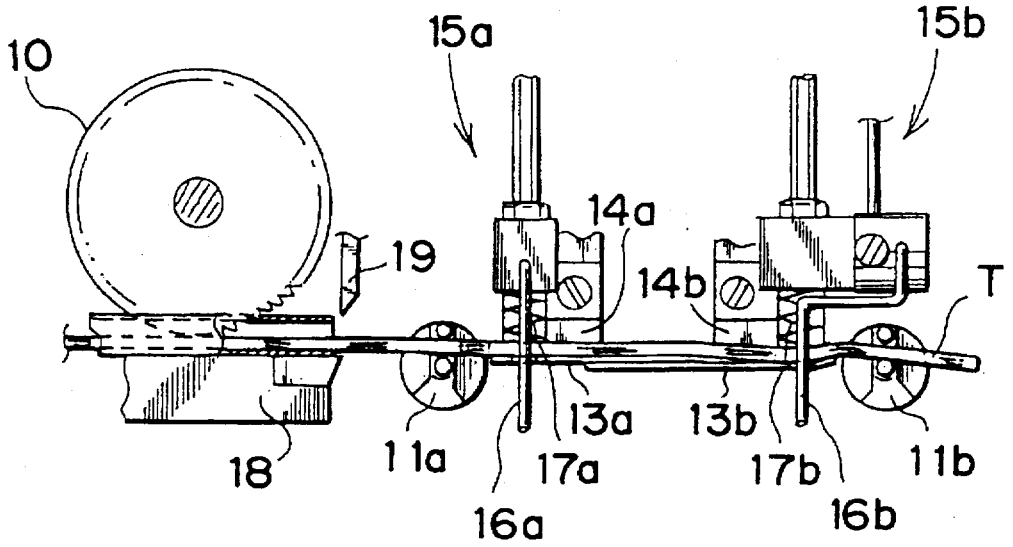
FIG. 7 is a front elevational view of two tape aligning and holding mechanisms when the tape is depressed thereby against the tape receiving plates.

As shown in FIGS. 1, 3, and 7, the tape folding shafts 11*a* and 11*b* are symmetrically disposed upstream of the tape receiving plate 13*a* and downstream of the tape receiving plate 13*b*, respectively. The tape folding shafts 11*a* and 11*b* are connected with rotary air cylinders 12*a* and 12*b* (only 12*b* is shown) and are carried by lower ends of swivelling levers 25*a* and 25*b* (only 25*b* is shown), respectively, so as to simultaneously rotate about 270° in opposite directions. The swivelling levers 25*a* and 25*b* are mounted on a movable bracket 7 via respective pins 24*a* and 24*b* (only 24*b* is shown). The movable bracket 7 is connected to a sliding mechanism 9 so as to move in a direction generally perpendicular to the direction of travel of the tape T. The sliding mechanism 9 includes a triple cylinder unit 4 comprising a first air cylinder 1, a second air cylinder 2, and a third air cylinder 3, all of which are disposed generally horizontally in line with one another. The triple cylinder unit 4 is pivotally connected at its one end 5 with a rear end (right-hand side in FIG. 3) of a feeder carrier 8 carrying the tape feeder F. An upper end of the movable bracket 7 is connected to the other end of the triple cylinder unit 4 via a horizontally extending pin 6.

Figure 2:
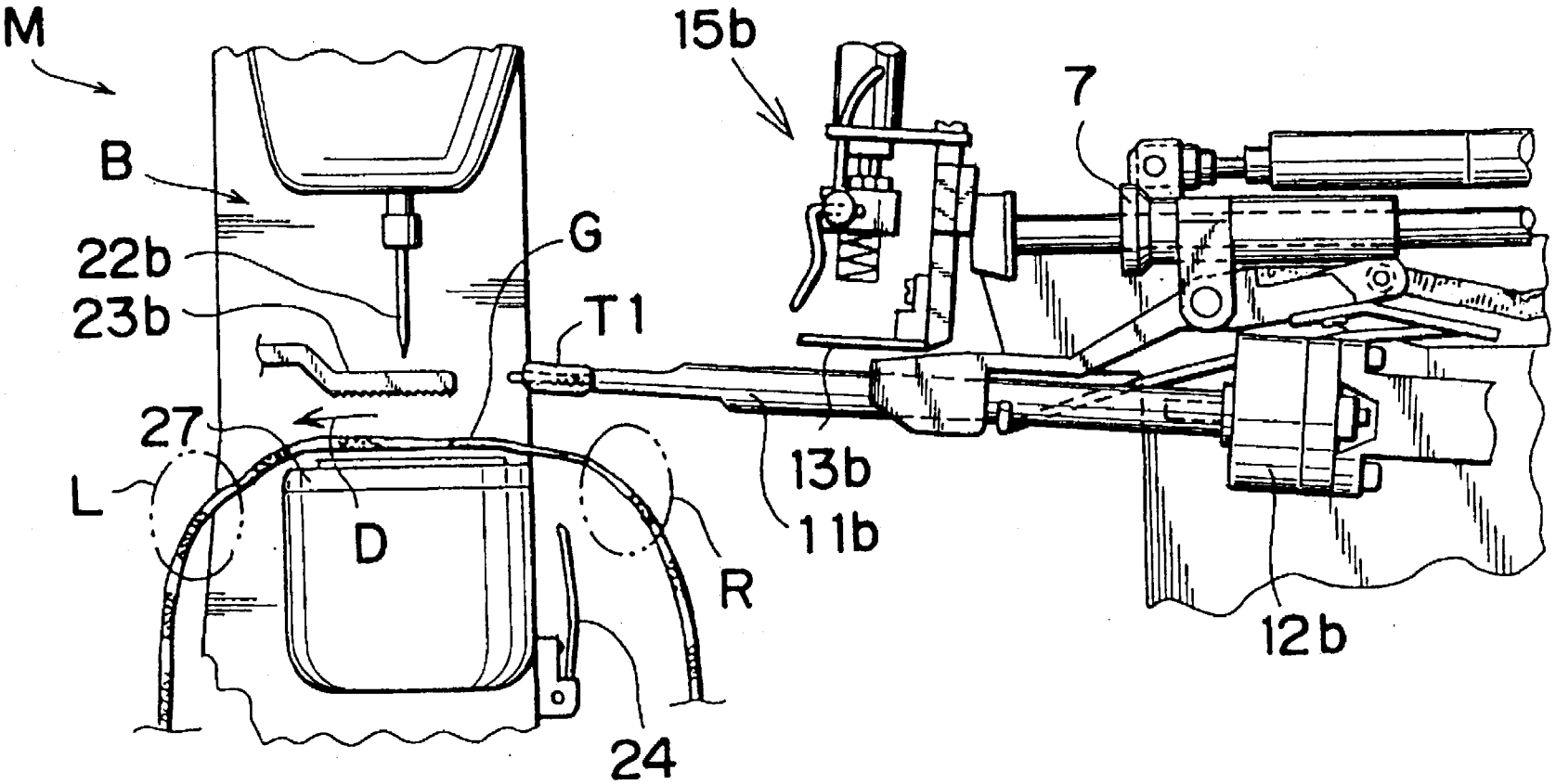
FIG. 2 is a front elevational view of the sewing machine of FIG. 1.
Figure 4:
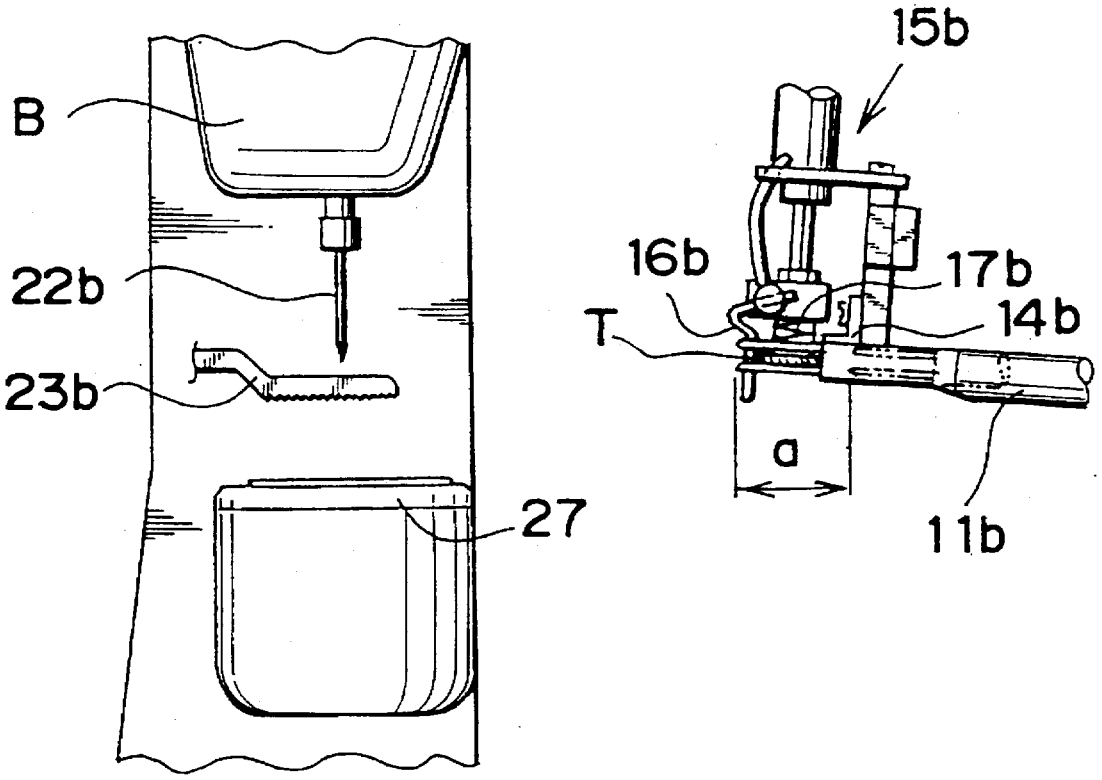
FIG. 4 is a front elevational view of the sewing machine, particularly indicating the state in which a length of tape placed on tape receiving plates is inserted between a center pin and a side pin both formed on a distal end of each of two tape folding shafts.

When the three air cylinders 1, 2, and 3 of the triple cylinder unit 4 are all at their retracted positions, the tape folding shafts 11*a* and 11*b* are positioned laterally of the tape receiving plates 13*a* and 13*b*. As shown in FIGS. 4 and 7, when the first air cylinder 1 is actuated, the tape folding shafts 11*a* and 11*b* are moved together with the movable bracket 7 towards the machine body B by a distance (a) of about 23 mm so that the opposite ends of the piece T1 of tape placed on the tape receiving plates 13*a* and 13*b* may be inserted between a center pin and a side pin of the associated tape folding shafts 11*a* and 11*b*. After the opposite ends of the piece T1 of tape have been folded by the tape folding shafts 11*a* and 11*b*, the second air cylinder 2 is actuated to further move the tape folding shafts 11*a* and 11*b* towards the machine body B so that the piece T1 of tape may be positioned immediately above a side edge of the sewing plate 27, as shown in FIGS. 1 and 2. Subsequent to the actuation of the first and second air cylinders 1 and 2, the third air cylinder 3 is actuated to further move the tape folding shafts 11*a* and 11*b* towards the machine body B so that the piece T1 of tape may be positioned immediately below the holding members 23*a* and 23*b* mounted on the machine body B.

Figure 6:
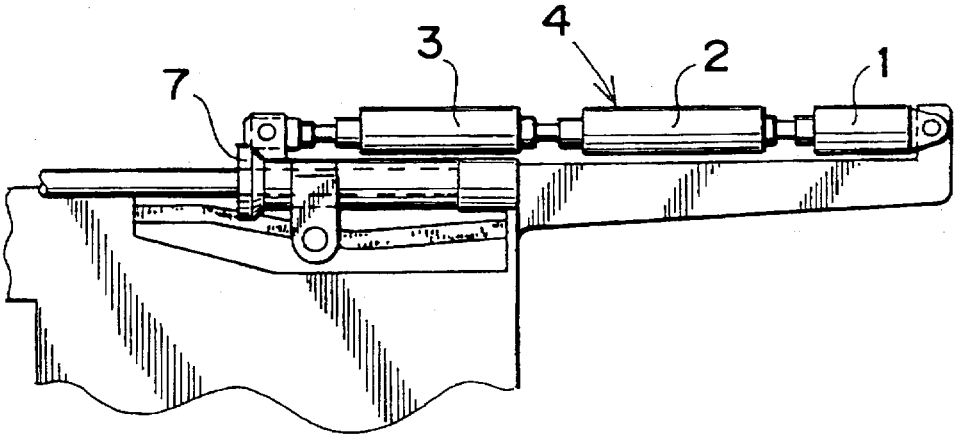
FIG. 6 is a front elevational view of a triple cylinder unit according to a modification thereof.

It is to be noted that although in FIG. 3 in order to minimize the overall length of the triple cylinder unit 4, each of the first and second air cylinders 1 and 2 has been illustrated as having a piston rod on the right-hand side, while the third air cylinder 3 connected to the second cylinder 2 has been illustrated as having a piston rod on the left-hand side, the three air cylinders 1, 2, and 3 may be connected in series with the piston rods thereof directed in the same direction, as shown in FIG. 6.

It is also to be noted that although in the above-described embodiment the tape feeder F is provided with the two bifurcated tape folding shafts 11*a* and 11*b* for folding opposite ends of the piece T1 of tape, means for forming a piece T1 of tape having opposite folded ends is not limited thereby, and any other suitable means can be used, mutatis mutandis.

Figure 13:
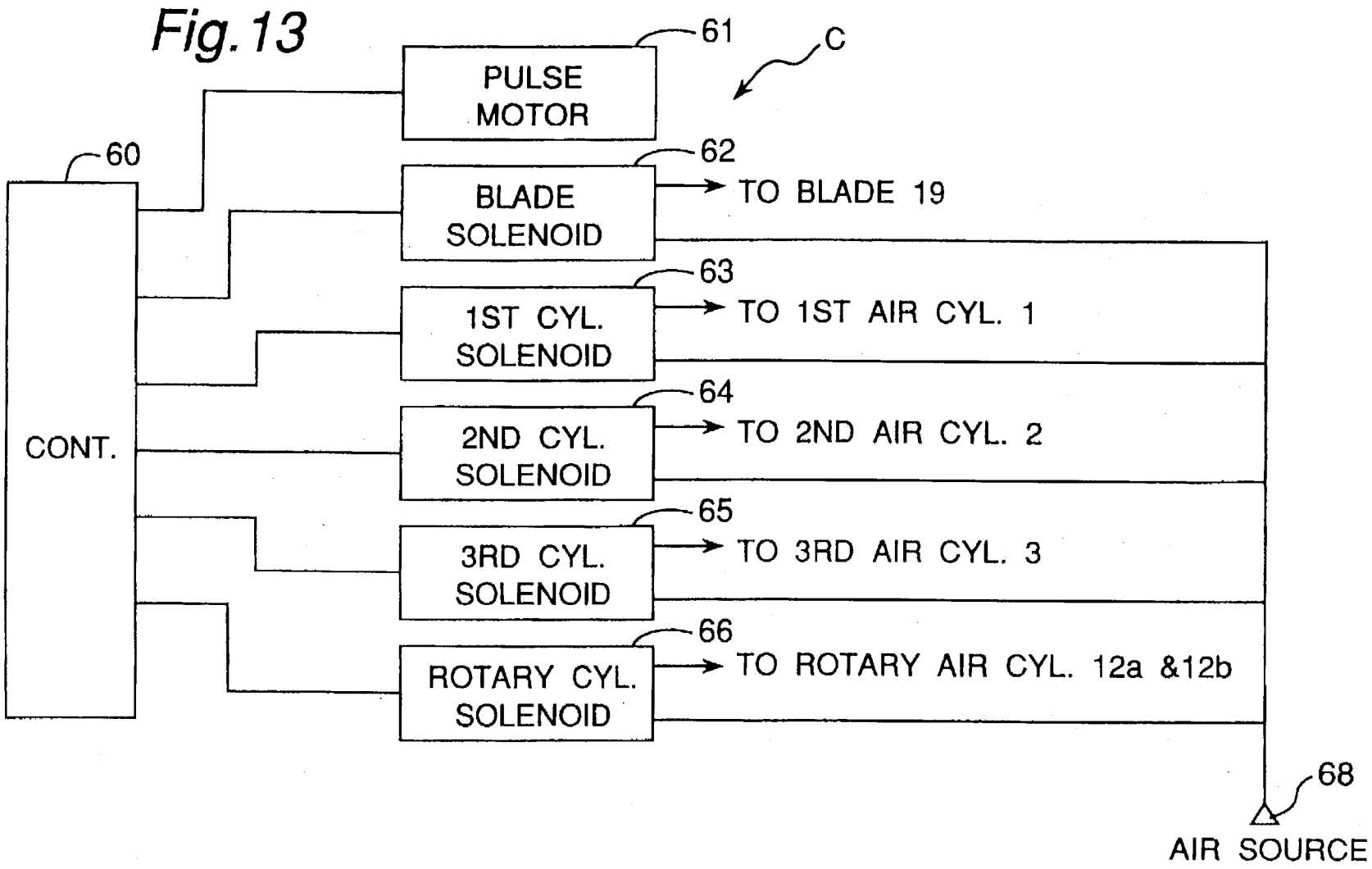
FIG. 13 is a block diagram of a control system for controlling the tape feeder of the present invention.
Figure 14:
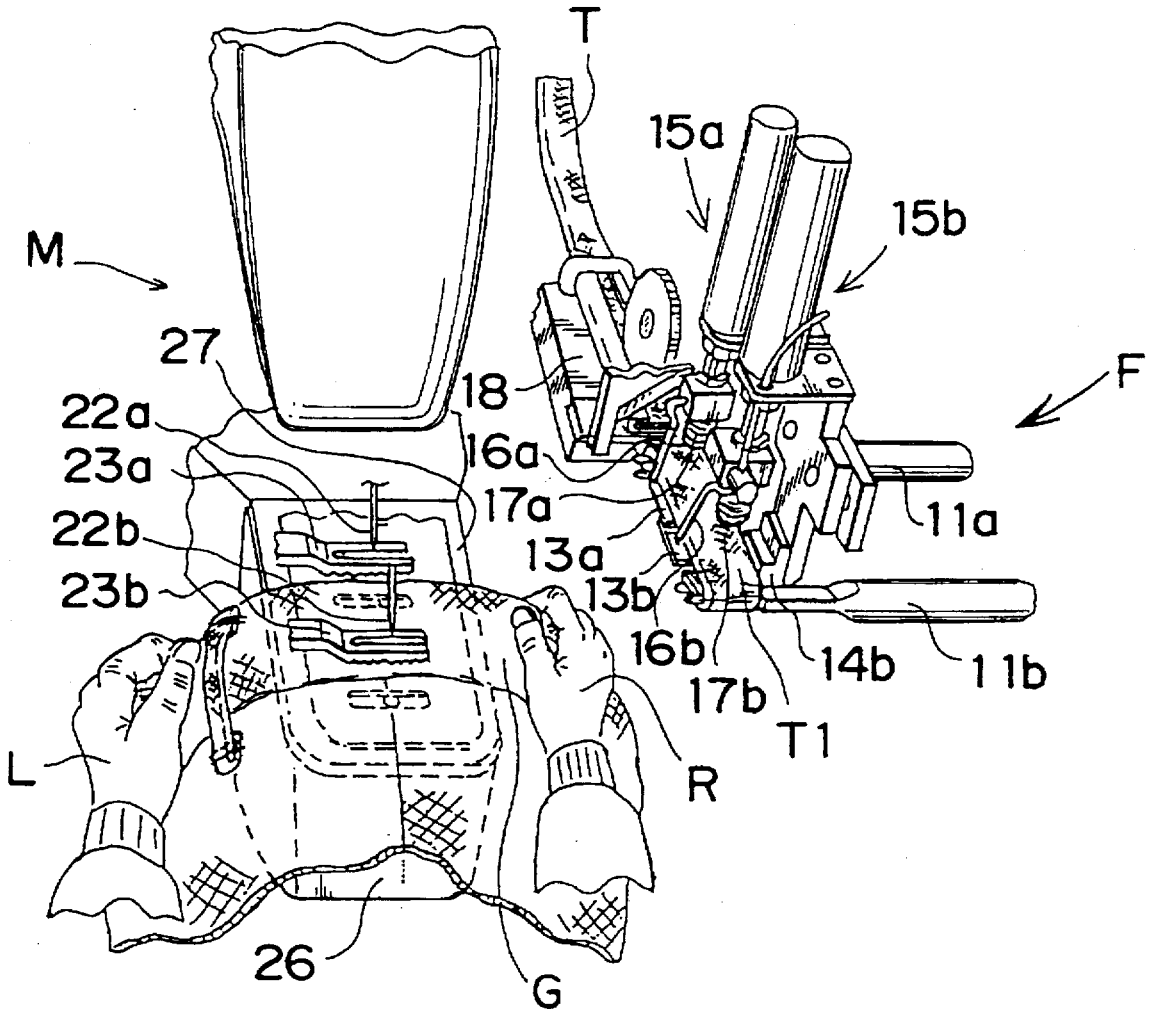
Fig. 14 PRIOR ART
FIG. 14 is a perspective view of a sewing machine having a conventional tape feeder.
Figure 15:
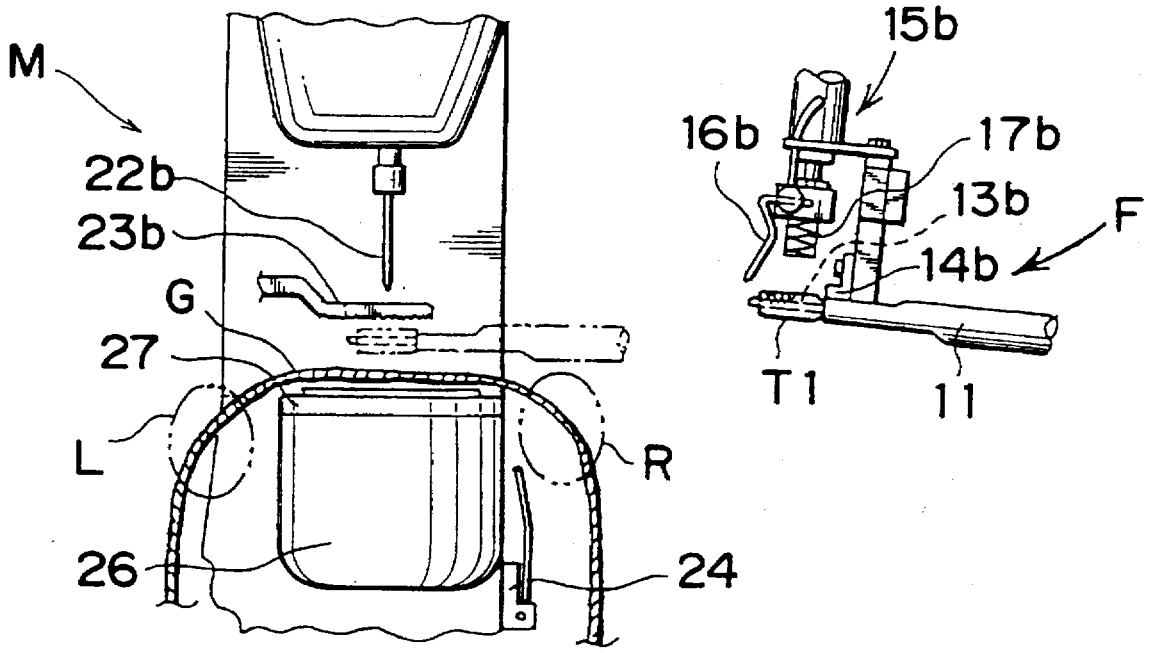
Fig. 15 PRIOR ART
FIG. 15 is a front elevational view of the sewing machine of FIG. 14.

FIG. 13 depicts a control system C for controlling the tape feeder F referred to above.

The control system C comprises a controller 60 having a microcomputer, a pulse motor 61 drivingly connected to the tape feed roller 10 via a drive force transmission means such as, for example, a chain, a blade operating solenoid 62 pneumatically connected to an air cylinder (not shown) for vertically moving the movable blade 19 to cut a length of tape T into pieces T1 of a predetermined length, a first cylinder operating solenoid 63 pneumatically connected to the first air cylinder 1, a second cylinder operating solenoid 64 pneumatically connected to the second air cylinder 2, a third cylinder operating solenoid 65 pneumatically connected to the third air cylinder 3, and a rotary cylinder operating solenoid 66 pneumatically connected to the two rotary air cylinders 12*a* and 12*b*. All of the pulse motor 61, the blade operating solenoid 62, the first to third cylinder operating solenoids 63 to 65, and the rotary cylinder operating solenoid 66 are electrically connected to and controlled by the controller 60. Furthermore, all of the solenoids 62 to 66 are pneumatically connected to an air source 68.

The sewing machine M of the above-described construction operates as follows.

When a length of tape T placed on the tape feed platform 18 is moved towards the tape receiving plates 13*a* and 13*b* by a predetermined distance by the tape feed roller 10 and is placed on the tape receiving plates 13*a* and 13*b*, two tape aligning and holding mechanisms 15*a* and 15*b* operate, as shown in FIGS. 4 and 7. More specifically, the tape T is moved laterally by two guide rods 16*a* and 16*b* until the side edge thereof is brought into contact with outwardly facing surfaces of two tape receiving pieces 14*a* and 14*b*. The tape T is then pressed against the tape receiving plates 13*a* and 13*b* by two compression coil springs 17*a* and 17*b*.

Thereafter, the first cylinder operating solenoid 63 actuates the first air cylinder 1 to move the movable bracket 7 together with the tape folding shafts 11*a* and 11*b* towards the machine body B until the tape T is inserted between the center and side pins of each of the tape folding shafts 11*a* and 11*b*.

Figure 8:
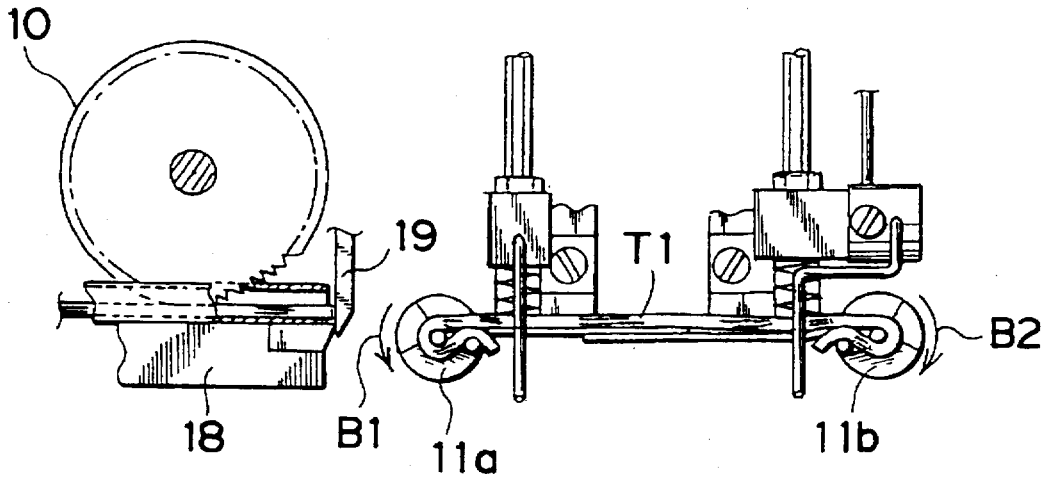
FIG. 8 is a view similar to FIG. 7, but indicating the state in which a piece of tape is cut off from the length of tape and opposite ends thereof are being folded by the tape folding shafts.
Figure 9:
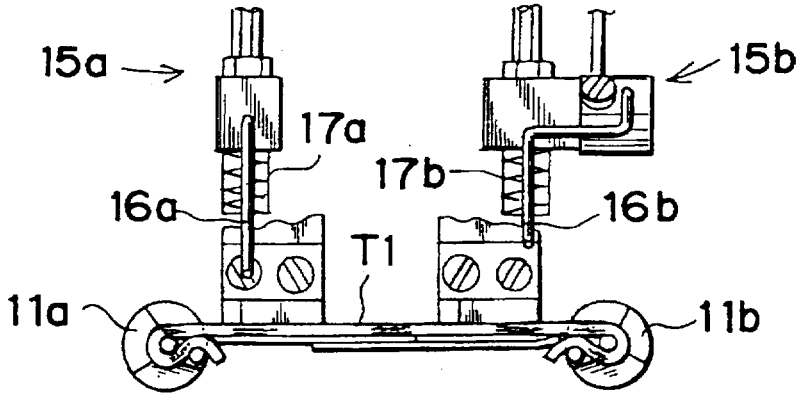
FIG. 9 is a front elevational view of the tape aligning and holding mechanisms when the depression of the piece of tape by the tape aligning and holding mechanisms is released.

When the blade operating solenoid 62 actuates the air cylinder for the movable blade 19 to cut the tape T, the tape folding shafts 11*a* and 11*b* are simultaneously rotated about 270° in opposite directions shown by B1 and B2 in FIG. 8, respectively, thereby folding opposite ends of a cut piece T1 of tape downwardly by about 180°. Then, the tape aligning and holding mechanisms 15*a* operate the guide rod 16*a* and the compression coil spring 17*a* to move upwardly, while the tape aligning and holding mechanisms 15*b* likewise operate the guide rod 16*b* and the compression coil spring 17*b* to move upwardly, as shown in FIG. 9.

Thereafter, the second cylinder operating solenoid 64 actuates the second air cylinder 2 to further move the movable bracket 7 together with the tape folding shafts 11*a* and 11*b* towards the machine body B until the piece T1 of tape having the opposite folded ends is located immediately above the side edge of the sewing plate 27, as shown in FIGS. 1 and 2. This condition is a stand-by condition in which the tape feeder F is in readiness for feeding the tape piece T1 of tape having the opposite folded ends to the machine body B. In the stand-by condition, because the tape folding shafts 11*a* and 11*b*, which have been located below the tape aligning and holding mechanisms 15*a* and 15*b*, are now located immediately above the side edge of the sewing plate 27, an operator can readily recognize the state of the piece T1 of tape.

Figure 10:
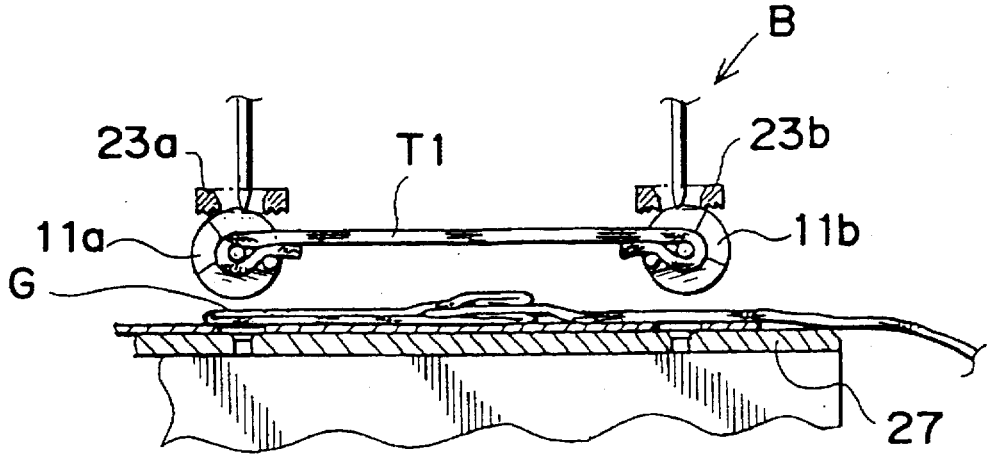
FIG. 10 is a partial front elevational view of the sewing machine when the piece of tape held by the tape folding shafts is fed immediately below the holding members.

When the operator places a waist part G of trousers on the sewing plate 27 and switches on a start switch 24 using his right hand R while continuing whether the piece T1 of tape is normally held by the tape folding shafts 11*a* and 11*b*, the third cylinder operating solenoid 65 actuates the third air cylinder 3 to further move the movable bracket 7 together with the tape folding shafts 11*a* and 11*b* until the piece T1 of tape is placed immediately below the holding members 23*a* and 23*b* of the machine body B, as shown in FIGS. 5 and 10.

Figure 11:
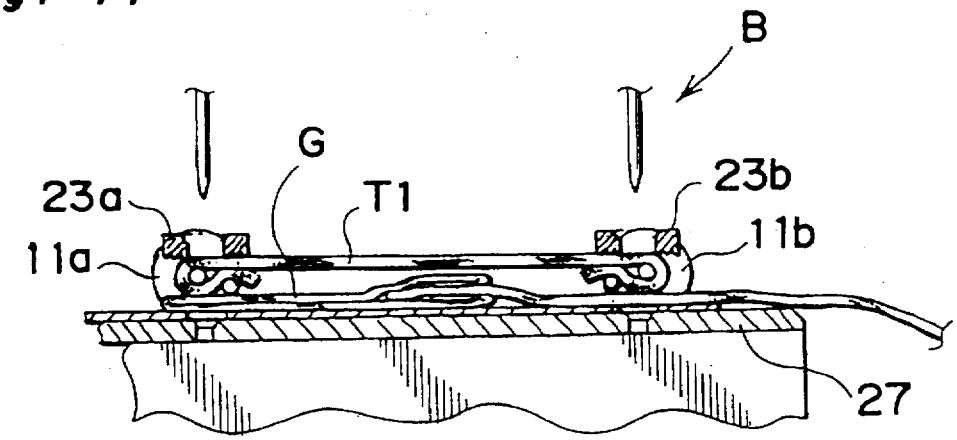
FIG. 11 is a view similar to FIG. 10, but indicating the state in which the opposite ends of the piece of tape are depressed together with the tape folding shafts by the holding members.

Subsequently, as shown in FIG. 11, the holding members 23*a* and 23*b* are simultaneously moved downwardly to press the opposite folded ends of the piece T1 of tape against the sewing plate 27.

Figure 12:
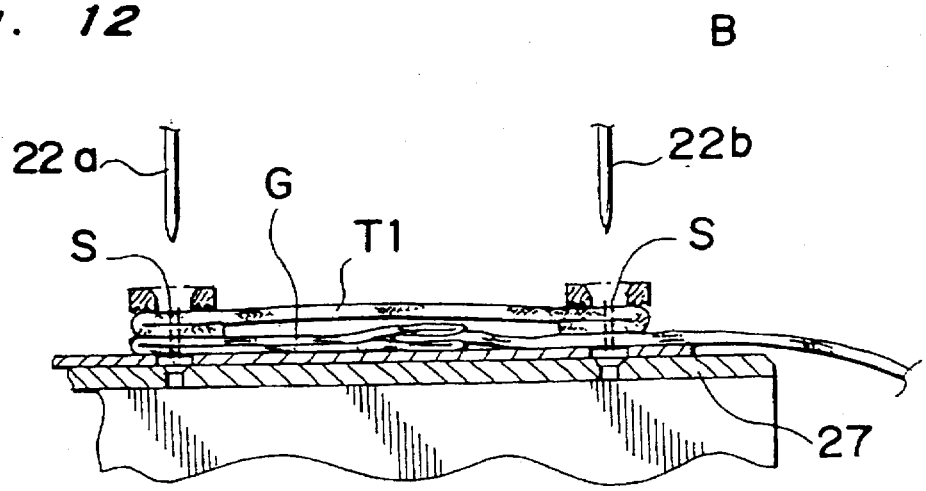
FIG. 12 is a view similar to FIG. 10, but indicating the state in which the folded piece of tape has been sewn on a waist part of trousers.

Thereafter, all of the first, second, and third air cylinders 1, 2 and 3 of the triple cylinder unit 4 are simultaneously moved away from the machine body B to retract the movable bracket 7 together with the tape folding shafts 11*a* and 11*b*, thereby drawing the center and side pins of the tape folding shafts 11*a* and 11*b* from the opposite folded ends of the piece T1 of tape. The piece T1 of tape is then sewn on the waist pan G of the trousers, as indicated by S in FIG. 12.

During the sewing operation, the tape folding shafts 11*a* and 11*b* are rotated, at their completely retracted positions, in directions opposite to the directions shown by arrows B1 and B2 in FIG. 8, respectively. Then, the tape T is fed onto the tape receiving plates 13*a* and 13*b* by a predetermined length corresponding to the overall length of the belt loop, and is cut by the movable blade 19 in the same manner as referred to above. Opposite ends of a cut piece T1 of tape are then folded downwardly by about 180°, and the piece T1 of tape is moved to and held at the position immediately above the side edge of the sewing plate 27 (stand-by condition as referred to above).

Upon completion of the sewing operation at one location on the waist part G of the trousers, the operator moves it in a direction shown by an arrow D in FIG. 2 so that that portion of the waist pan G of the trousers on which the next piece T1 of tape is to be sewn is positioned immediately below the needles 22*a* and 22*b*. At this moment, because the right hand R of the operator, indicated by a double-dotted chain line in FIG. 2, is positioned below the tape folding shafts 11*a* and 11*b* being at a standstill, the operator feels safe in moving the waist part G of the trousers.

Upon completion of the positioning of the waist part G of the trousers, the operator switches on the start switch 24 to feed the piece T1 of tape having the opposite folded ends in the stand-by condition onto the sewing plate 27 while confirming whether the piece T1 of tape is normally held by the tape folding shafts 11*a* and 11*b*. The same operation as referred to above is repeatedly carried out so that a required number of belt loops may be successively sewn on the waist part G of the trousers.

If the operator has discovered that in the stand-by condition the folding of the opposite ends of the piece T1 of tape by the tape folding shafts 11*a* and 11*b* is incomplete, he can retract the tape folding shafts 11*a* and 11*b* to a position laterally of the tape receiving plates 13*a* and 13*b* by switching on a setback switch (not shown) to cause the controller 60 to start the folding again. By so doing, the tape folding shafts 11*a* and 11*b* are returned to their retracted positions laterally of the tape receiving plates 13*a* and 13*b*, allowing the operator to remove the incompletely folded piece of tape. Thereafter, the controller 60 causes the tape feeder F to start the folding of a piece T1 of tape again and, upon folding, the piece T1 of tape is moved to the stand-by position immediately above the side edge of the sewing plate 27 in readiness for a subsequent sewing operation.

As is clear from the above, according to the present invention, because each piece T1 of tape, opposite ends of which have been folded and held by the two tape folding shafts 11*a* and 11*b*, is caused to wait at the position above the side edge of the sewing plate 27, the operator feels safe in moving the waist part G of the trousers to the position immediately below the holding members 23*a* and 23*b* using his hands R and L. The reason for this is that if he moves his right hand R too upwardly, it inevitably impinges on lower surfaces of the tape folding shafts 11*a* and 11*b*, thus causing him to move his right hand R downwardly.

According to the conventional method of feeding a piece of T1 tape to a sewing machine M, because the stand-by position at which the piece T1 of tape folded and held by the tape folding shafts 11*a* and 11*b* is caused to wait is a tape folding position, distal ends thereof are spaced a distance away from the machine body B and, hence, there is a good chance of the operator unintentionally moving his right hand R to a space between the distal ends of the tape folding shafts 11*a* and 11*b* and the machine body B. Accordingly, it is very likely that his right hand R is thrust with the tape folding shafts 11*a* and 11*b*. According to the present invention, however, because the stand-by position is above the side edge of the sewing plate 27, there is no space to introduce his right hand R thereinto and, hence, there is no danger of his right hand R being injured by the advancing tape folding shafts 11*a* and 11*b*.

Furthermore, the conventional stand-by position is a position below the tape aligning and holding mechanisms 15*a* and 15*b* and is hard to recognize, whereas according to the present invention, the stand-by position is above the side edge of the sewing plate 27 and, hence, the operator can easily recognize whether the piece T1 of tape is satisfactorily folded and held by the tape folding shafts 11*a* and 11*b*. Accordingly, if poor or incomplete folding occurs, the operator can easily discover it and can remove the piece T1 of tape from the tape folding shafts 11*a* and 11*b*.

Also, according to the present invention, the distance between the stand-by position and the needles 22*a* and 22*b* is reduced to half or less, compared with the conventional distance between the tape folding position (conventional stand-by position) and the needles 22*a* and 22*b*. Accordingly, the period of time within which the appropriately folded piece T1 of tape is fed, when the operator switches on the start switch 24, from the stand-by position to the position immediately below the holding members 23*a* and 23*b* can be reduced to half or less, compared with the conventional method.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A method of feeding a piece of tape to a sewing machine having a sewing plate on which the piece of tape is first held by a holding means and is subsequently sewn as a belt loop on a garment, said method comprising the steps of:

(a) folding opposite ends of the piece of tape at a position spaced away from the sewing plate;

(b) moving the piece of tape to a stand-by position adjacent to the sewing plate, said stand-by position limiting a space between said sewing plate and said piece of tape to be smaller than an operator's hand; and (c) further moving the piece of tape to a position below the holding means so that the piece of tape may be sewn as a belt loop on the garment.

2. The method according to claim 1, wherein said stand-by position is above a side edge of the sewing plate.

3. The method according to claim 1, wherein the step (a) is carried out by rotating two bifurcated tape folding shafts in opposite directions.

4. A tape feeder for feeding a piece of tape to a sewing machine having a sewing plate on which the piece of tape is first held by a holding means and is subsequently sewn as a belt loop on a garment, said tape feeder comprising:

a feeder carrier;

a triple cylinder unit having opposite first and second ends and also having first, second and third cylinders connected in series with one another, the first end of said triple cylinder unit being pivotally connected to said feeder carrier;

a movable bracket connected to the second end of said triple cylinder unit;

two tape folding shafts, rotatably carried by said movable bracket, for folding opposite ends of a piece of tape; and a control means for controlling said triple cylinder unit and said tape folding shafts, whereby actuation of said first cylinder moves said tape folding shafts towards a first position, at which the piece of tape is placed, so that distal ends of said tape folding shafts are located at the first position, said two tape folding shafts being then rotated in opposite directions to thereby fold and hold the opposite ends of the piece of tape, a subsequent actuation of said second cylinder moving said tape folding shafts towards a second position adjacent to the sewing plate so that the piece of tape held by said tape folding shafts is located at the second position, a subsequent actuation of said third cylinder moving said tape folding shafts towards a third position so that the piece of tape held by said tape folding shafts is located immediately below said holding means.

5. The tape feeder according to claim 4, wherein said second position is above a side edge of said sewing plate.

6. A method of feeding a piece of tape to a sewing machine having a sewing plate on which the piece of tape is first held by a holding means and is subsequently sewn as a belt loop on a garment, said method comprising the steps of:

(a) folding opposite ends of the piece of tape at a position spaced away from the sewing plate;

(b) moving the piece of tape to a stand-by position adjacent to the sewing plate; and (c) further moving the piece of tape to a position below the holding means so that the piece of tape may be sewn as a belt loop on the garment, wherein said moving step (b) is completed before a previous piece of tape is sewn on the garment.

* * * * *